United States Patent [19]

Awad

[11] Patent Number: 5,030,323

[45] Date of Patent: Jul. 9, 1991

[54] SURFACE CONDITIONER FOR FORMED METAL SURFACES

[75] Inventor: Sami B. Awad, Drexel Hill, Pa.

[73] Assignee: Henkel Corporation, Ambler, Pa.

[21] Appl. No.: 492,695

[22] Filed: Mar. 13, 1990

Related U.S. Application Data

[63] Continuation-in-part of Ser. No. 395,620, Aug. 18, 1989, Pat. No. 4,944,889, which is a continuation-in-part of Ser. No. 57,129, Jun. 1, 1987, Pat. No. 4,859,351.

[51] Int. Cl.[5] ..... C23F 1/00; B44C 1/22; C10M 137/04

[52] U.S. Cl. ..... 156/665; 134/3; 156/664; 252/32.5; 252/32; 252/79.2; 252/79.3; 252/79.4

[58] Field of Search ..... 252/79.2, 79.3, 79.4, 252/32, 32.5; 156/656, 664, 665; 134/3, 41

[56] References Cited

U.S. PATENT DOCUMENTS

| | | | |
|---|---|---|---|
| 3,964,936 | 6/1976 | Das | 148/6.27 |
| 4,148,670 | 4/1979 | Kelly | 148/6.15 |
| 4,859,351 | 8/1989 | Awad | 252/32.5 |

*Primary Examiner*—William A. Powell
*Attorney, Agent, or Firm*—Ernest G. Szoke; Wayne C. Jaeschke; Norvell E. Wisdom, Jr.

[57] ABSTRACT

Contact of acid or alkaline cleaned aluminum surfaces, particularly cans, with a water based composition containing a combination of (i) ethoxylated phosphate esters, ions of aluminum, zirconium, iron, tin, and/or cerium, and (iii) a metal etching component gives the surface after drying lowered surface friction without loss of high quality printability and lacquer adhesion and removes any brown spotting on the cans that may have developed during the cleaning or post-cleaning rinses.

20 Claims, No Drawings

SURFACE CONDITIONER FOR FORMED METAL SURFACES

CROSS REFERENCE TO RELATED APPLICATIONS

This application is a continuation-in-part of copending application Ser. No. 395,620 filed Aug. 18, 1989, U.S. Pat. No. 4,944,889, which was a continuation-in-part of application Ser. No. 57, 129 filed June 1, 1987, now U.S. Pat. No. 4,859,351. The entire content of the specification of U.S. Pat. No. 4,859,351 is hereby incorporated herein by reference. This patent is generally referred hereinafter as "the U.S. Pat. No. 4,859,351" for brevity. All parts of application Ser. No. 395,620 filed Aug. 18, 1989 that are not duplicated in U.S. Pat. No. 4,859,351 are also hereby incorporated herein by reference.

BACKGROUND OF THE INVENTION

1. Field of the Invention

In addition to the general field given in the U.S. Pat. No. 4,859,351, this invention is particularly directed to compositions, and processes for using them, that produce a treated formed metal surface that is substantially or entirely free from "water breaks" when wet, or in other words, a surface over which any water present on the surface spreads spontaneously.

2. Statement of Related Art

In addition to the art already of record in the U.S. Pat. No. 4,859,351, Kelly U.S. Pat. No. 4,148,670 of Apr. 10, 1979 teaches a conversion coating solution for aluminum containing compounds of zirconium and/or titanium, fluoride, and phosphate, and optionally also polyhydroxy compounds, in dissolved form. The phosphate taught is conventional inorganic phosphate, and no mobility enhancing benefit obtained by the treatment is taught.

Das U.S. Pat. No. 3,964,936 of June 22, 1976 teaches a conversion coating solution for aluminum which produces a surface that maintains its shiny appearance and resists discoloration even when treated with boiling water. The coating solution contains compounds of zirconium and fluorine and may also contain boric acid. No use of a phosphorus containing component is taught, nor is any mobility enhancement from the treatment.

DESCRIPTION OF THE INVENTION

In this description, except in the operating examples or where explicitly otherwise indicated, all numbers describing amounts of ingredients or reaction conditions are to be understood as modified by the word "about".

It has now been found that a formed aluminum surface, which has been conventionally thoroughly cleaned and degreased by sufficient contact with a water based acid or alkaline cleaner, can be effectively and advantageously surface conditioned so as to impart increased mobility, i.e., a lower coefficient of static surface friction, to the surface when subsequently dried, without harming the reflectivity or printability of, or the adherence of lacquer to, the treated surface, by contacting the surface with a composition comprising, or preferably consisting essentially of, water and the following components:

(A) a component of water soluble materials selected from the group conforming to general chemical formula I:

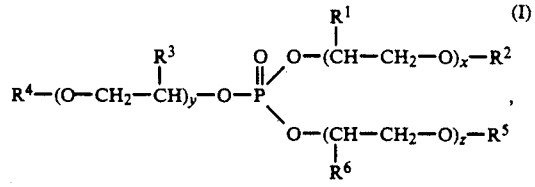

(I)

wherein each of $R^1$, $R^3$, and $R^6$ is independently selected from hydrogen and alkyl groups containing 1–4 carbon atoms, preferably from hydrogen and methyl, most preferably hydrogen; each of x, y, and z is an integer and is independently selected within the range from 0–25; and each of $R^2$, $R^4$, and $R^5$ is independently selected from hydrogen, monovalent cations, monovalent fractions of polyvalent cations, alkyl groups containing 1–20 carbon atoms, and aryl and arylalkyl groups containing 1–20 carbon atoms; except that at least one of $R^2$, $R^4$, and $R^5$ (i) is not hydrogen and (ii) has at least one alkoxyl group bonded between it and the phosphorous atom in formula I;

(B) a component selected from the group of water soluble salts containing ions that comprise atoms selected from the group consisting of Fe, Zr, Sn, Al, and Ce; and (C) a metal etching component, preferably selected from the group consisting of nitric acid, sulfuric acid, phosphoric acid, hydrofluoric acid, hydrochloric acid, hydrobromic acid, hydroiodic acid, acid salts of sulfuric and phosphoric acids, salts of nitric, sulfuric, phosphoric, hydrofluoric, hydrochloric, hydrobromic, and hydroiodic acids with bases having an ionization product constant less than that of the acid with which they form the salt, and mixtures of any of these; and, optionally, (D) a component selected from chelating agents for the metal containing ions of component (B), preferably selected from the group consisting of molecules, including polymer molecules, each containing at least two of the following groups: amino, substituted amino, carboxyl, phosphonate, sulfonate, and carbonyl; and (E) a component selected from molecules conforming to general formula II;

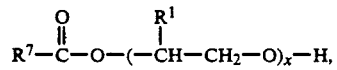

(II)

wherein $R^7$ is a linear or branched, saturated or unsaturated monovalent aliphatic hydrocarbon moiety and $R^1$ and x have the same meaning as for formula I.

It should be noted that not all of the specified components must be separate materials. Fluorozirconic acid (i.e. $H_2ZrF_6$), for example, can serve as both component (B) and component (C).

It is preferable for component (A) to be selected from molecules conforming to formula I when each of x and z is zero and each of $R^2$ and $R^5$ is hydrogen or a cation or cation fraction, and such materials can serve as all of components (A), (B), and (C), for example if $R^2$ is hydrogen and $R^5$ is $(\frac{1}{3})Fe^{+3}$.

It is preferred that component (A) in the solution used for treating according to this invention be such as to provide a concentration of from 0.00001 to 0.0032 gram atoms of phosphorus per liter, or more preferably from 0.0005 to 0.0015 gram atoms of phosphorus per liter. It is also independently preferred that component (B) in the solution used for treating according to this invention be such as to provide a concentration of from 0.00001 to 0.01 gram atoms per liter, or more preferably from 0.0001 to 0.003 gram atoms per liter, of the total of all metal atoms recited in component (B).

It is also independently preferred that component (A) be selected from molecules according to formula I when (i) x is either zero or not less than 0.5 the number of carbon atoms in $R^2$; (ii) y is either zero or not less than 0.5 the number of carbon atoms in $R^4$; and (iii) z is either zero or not less than 0.5 the number of carbon atoms in $R^5$. It is increasingly more preferred if at least 50%, at least 75% or at least 90% of component (A) is selected from mono (hexyltriethyoxyl) diacid phosphate, i.e., $$C_6H_{13}—(O—CH_2—CH_2)_3—O—PO(OH)_2,$$

and its salts.

Irrespective of its detailed composition, the composition with which the formed aluminum surface is contacted during a process according to this invention preferably contains from 0.001 to 10% by weight ("w %"), more preferably 0.005–0.05 w %, of the total of components (A), (B), and (C), as described above, with optional components and water making up the balance. The water used need not necessarily be deionized or otherwise specially purified; ordinary tap water usually gives satisfactory results. The pH of the composition during contact with a formed aluminum surface preferably is in the range of 1–8, more preferably in the range of 2–5. The pH may be adjusted as needed, preferably with nitric and/or sulfuric acid, during use, in order to maintain the pH within the desired range. The temperature of the composition during contact with the formed aluminum surface is preferably from 10°–85° C., more preferably from 21°–54° C. Contact may be by spraying, immersion, or any other convenient method or mixture of methods. Preferably the time of contact is from 5–60, more preferably from 20–30, seconds. It is also generally preferable to rinse the treated surface first with tap water and then again with deionized water after treatment according to the invention and before further processing, such as drying, printing, lacquering, or the like.

In addition to a process of treating and the composition used directly for treating, another embodiment of the invention is a concentrate from which the composition to be used for treating can be made by dilution with water. Such a concentrate preferably contains the components (A), (B), (C), and optionally (D) and/or (E), noted above in an amount of from 30–200 times the w % level noted above for the composition for actual use.

The compositions and methods of this invention have several advantages over those described in the U.S. Pat. No. 4,859,351:

after treatment according to this invention, a surface can be rinsed many more times with tap or deionized water without losing improved surface mobility and other advantages than can a surface treated according to the examples of the U.S. Pat. No. 4,859,351;

if there is prolonged contact between the treated surface and a cleaning composition or one of the rinses after cleaning but prior to treatment with a composition according to this invention (as a result of unplanned stoppages of a high speed production line, for example), light-to-deep brown spots, believed to be hydrated aluminum oxide, sometimes form on the treated surface; any such spots are removed by treatment according to this invention, whereas they usually persist after using a process as taught in the examples of the U.S. Pat. No. 4,859,351;

a process according to this invention may more readily be operated at a pH sufficiently low to inhibit bacterial growth than one according to the examples of the U.S. Pat. No. 4,859,351;

almost any readily available industrial or tap water supply may be used for makeup or dilution of a composition according to this invention, while that taught in the U.S. Pat. No. 4,859,351 generally needs deionized water for best results;

the surfaces produced by a process according to the present invention are very readily wet by water and thus remain free of "water breaks", which are considered undesirable by most aluminum can processors; cans processed according to the examples of the U.S. Pat. No. 4,859,351 are much more likely to exhibit water breaks.

In addition, all the advantages of increased mobility, low surface coefficient of friction, high quality printability, and good adhesion of lacquers and the like as taught in the U.S. Pat. No. 4,859,351 are retained for treatments according to this invention.

The practice of this invention may be further appreciated by consideration of the following non-limiting examples.

EXAMPLES

General Conditions

In all the following examples, the surfaces treated were those of conventional aluminum beverage cans already in their final shape and size. The cans were subjected to an acid prewash in an aqueous solution sulfuric acid having a pH of 2 for 30 seconds ("sec") at 54° C., then to washing with a conventional alkaline, surfactant containing cleaner at pH 12.3 for 60 sec at 54° C., and then to a 30 sec tap water rinse before being treated with a composition according to this invention as set forth in the specific examples below. (The compositions given in the specific examples are for concentrates according to this invention; for treatment, a solution of the w % of the concentrate specified in Table 1, in tap water, was used.) After this treatment, the cans were rinsed first in tap water for 30 sec, then in deionized water for 90 sec, and dried at 210° C. The coefficient of static surface friction on the cans after drying was measured as described in the U.S. Pat. No. 4,859,351.

EXAMPLE 1

The concentrate for this example had the following composition:

| Ingredient | Parts by Weight in Composition |
|---|---|
| Stannic chloride solution, 25% by weight in water | 300 |
| ETHFAC 136 | 400 |
| ETHOX MI-14 | 100 |
| Ammonium bifluoride solution, 25% by weight in water | 135 |
| DEQUEST 2010 | 25 |

-continued

| Ingredient | Parts by Weight in Composition |
|---|---|
| Water | 9040 |

EXAMPLE 2

The concentrate for this example had the following composition:

| Ingredient | Parts by Weight in Composition |
|---|---|
| Ferric ammonium citrate solution, 25% by weight in water | 300 |
| ETHFAC 136 | 400 |
| ETHOX MI-14 | 100 |
| Ammonium bifluoride solution, 25% by weight in water | 135 |
| DEQUEST 2010 | 25 |
| Water | 9040 |

EXAMPLE 3

The concentrate for this example had the following composition:

| Ingredient | Parts by Weight in Composition |
|---|---|
| Cerium ammonium sulfate | 4 |
| ETHFAC 136 | 30 |
| Ammonium bifluoride solution, 25% by weight in water | 16 |
| DEQUEST 2010 | 2 |
| Sulfuric acid | 1 |
| TRITON N101 | 5 |
| Water | 942 |

EXAMPLE 4

The concentrate for this example had the following composition:

| Ingredient | Parts by Weight in Composition |
|---|---|
| Aluminum chloride | 10 |
| ETHFAC 136 | 50 |
| Ammonium bifluoride solution, 25% by weight in water | 11 |
| TRITON N101 | 6 |
| Citric acid | 6 |
| Ethoxylated alcohol surfactant | 11 |
| Water | 906 |

EXAMPLE 5

The concentrate for this example had the following composition:

| Ingredient | Parts by Weight in Composition |
|---|---|
| Fluorozirconic acid | 15 |
| Mono(hexyltriethoxy) phosphate | 70 |
| Poly(oxyethylene) isostearate with an average of 14 oxyethylene units per isostearate unit | 20 |
| Ammonium bifluoride solution, 25% by weight in water | 19 |
| Aminoacetic acid | 20 |

-continued

| Ingredient | Parts by Weight in Composition |
|---|---|
| Water | 856 |

EXAMPLE 6

The concentrate for this example had the following composition:

| Ingredient | Parts by Weight in Composition |
|---|---|
| Fluorozirconic acid | 15 |
| Mono(hexyltriethoxy) phosphate | 30 |
| ETHOX MI-14 | 20 |
| Ammonium bifluoride solution, 25% by weight in water | 15 |
| Butane-2-phosphonic acid tricarboxylate | 10 |
| Water | 910 |

EXAMPLE 7

The concentrate for this example had the following composition:

| Ingredient | Parts by Weight in Composition |
|---|---|
| Fluorozirconic acid | 10 |
| Polyoxyethylene isostearate containing an average of 14 moles of ethoxyl groups per mole of isostearate | 10 |
| TRITON H-66 | 80 |
| DEQUEST 2010 | 2.5 |
| Ammonium bifluoride solution, 25% by weight in water | 4 |
| Water | 893.5 |

In the compositions given above, DEQUEST 2010 is a trade name for a material that is reported to be predominantly 1-hydroxyethylidene-1-diphosphonic acid, and TRITON N101 is a trade name for a surfactant material that is reported to be predominantly nonylphenoxypoly(ethoxy)ethanol, with an average of 9–10 ethoxy groups per molecule.

The specific amounts of the concentrates used, treatment conditions, and the coefficients of static surface friction achieved on the cans by sorption of a lubricant and surface conditioning layer for Experiments 1–8 are shown in Table 1.

TABLE 1

IMPROVEMENT IN SURFACE FRICTION FROM TREATMENT ACCORDING TO THIS INVENTION

| Experiment Number | % by Weight of Concentrate in Treatment Solution | Treatment Conditions: Temperature, Degrees C. | Treatment Conditions: Time, Seconds | Coefficient of Static Surface Friction |
|---|---|---|---|---|
| 1 | 1.0 | 35 | 20 | 1.27 |
| 2 | 1.0 | 35 | 20 | 1.47 |
| 3 | 1.0 | 35 | 20 | 1.31 |
| 4 | 1.0 | 35 | 20 | 0.77 |
| 5 | 1.0 | 35 | 20 | 0.77 |
| 6 | 1.0 | 35 | 20 | 1.20 |
| 7 | 1.0 | 35 | 20 | 1.01 |
| No treatment | | | | 1.67 |

What is claimed is:

1. A process comprising steps of:

(a) cleaning the surface of an aluminum object having the shape and size intended for final use, by contacting the surface for an effective time with an aqueous based liquid cleaning composition having ingredients effective to produce a thoroughly degreased, clean surface substantially free from aluminum fines and other solid contamination;

(b) (i) rinsing the surface cleaned as recited in step (a) with additional water and (ii) drying the rinsed surface; and (c) conveying the object with a cleaned and dried surface produced as recited in steps (a) and (b) via high speed automatic conveying equipment, wherein the improvement comprises contacting the aluminum surface after cleaning and rinsing as recited in steps (a) and (b)(i) but before the drying recited in step (b)(ii), with a liquid composition comprising water and the following components:

(A) a component of water soluble materials selected from the group conforming to general chemical formula I:

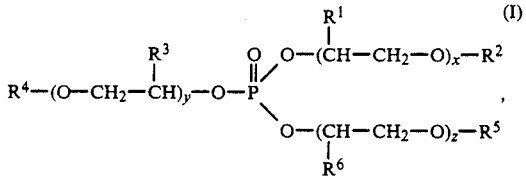

(I)

wherein each of $R^1$, $R^3$, and $R^6$ is independently selected from hydrogen and alkyl groups containing 1-about 4 carbon atoms each of x, y, and z is an integer and is independently selected within the range from 0-about 25; and each of $R^2$, $R^4$, and $R^5$ is independently selected from hydrogen, monovalent cations, monovalent fractions of polyvalent cations, alkyl groups containing 1-about 20 carbon atoms, and aryl and arylalkyl groups containing 1-about 20 carbon atoms, except that at least one of $R^2$, $R^4$, and $R^5$ (i) is not hydrogen and (ii) has at least one alkoxyl group bonded between it and the phosphorous atom in formula I;

(B) a component selected from the group of water soluble salts containing ions that comprise atoms selected from the group consisting of Fe, Zr, Sn, Al, and Ce; and (C) a water soluble metal etching component; and, optionally, (D) a water soluble component selected from chelating agents for the metal containing ions of component (B) and (E) a water soluble component selected from molecules conforming to general formula II:

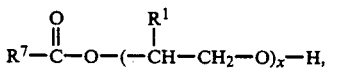

(II)

wherein $R^7$ is a linear or branched, saturated or unsaturated aliphatic hydrocarbon moiety and $R^1$ and x have the same meaning as for formula I, the contacting of the aluminum surface with the recited composition being at an effective temperature for a sufficient time to cause the coefficient of static surface friction of the aluminum object with the surface so treated to be less than 1.5.

2. A process according to claim 1, wherein component (A) is selected from molecules according to formula I when each $R^2$, $R^3$, $R^6$ is hydrogen, each of x and z is zero, and y is not less than about 0.5 times the number of carbon atoms in $R^4$.

3. A process according to claim 2, wherein at least about 75% by weight of component (A) is selected from mono(hexyltriethoxy) diacid phosphate and its salts.

4. A process according to claim 3, wherein, in the composition comprising components (A)-(C), the concentration of phosphorus is in the range from about 0.00001 to about 0.0032 gram atoms per liter and the total concentration of all the metal atoms recited in component (B) is in the range of about 0.00001 to about 0.01 gram atoms per liter.

5. A process according to claim 2, wherein, in the composition comprising components (A)-(C), the concentration of phosphorus is in the range from about 0.00001 to about 0.0032 gram atoms per liter and the total concentration of all the metal atoms recited in component (B) is in the range of about 0.00001 to about 0.01 gram atoms per liter.

6. A process according to claim 1, wherein, in the composition comprising components (A)-(C), the concentration of phosphorus is in the range from about 0.00001 to about 0.0032 gram atoms per liter and the total concentration of all the metal atoms recited in component (B) is in the range of about 0.00001 to about 0.01 gram atoms per liter.

7. A process according to claim 6, wherein the total concentration of components (A), (B), and (C) in the treating solution containing them is between about 0.005 and about 0.05 w %, the pH of the treating solution is between about 1 and about 8, and the temperature during treatment is between about 10° and about 85° C.

8. A process according to claim 5, wherein the total concentration of components (A), (B), and (C) in the treating solution containing them is between about 0.005 and about 0.05 w %, the pH of the treating solution is between about 1 and about 8, and the temperature during treatment is between about 10° and about 85° C.

9. A process according to claim 4, wherein the total concentration of components (A), (B), and (C) in the treating solution containing them is between about 0.005 and about 0.05 w %, the pH of the treating solution is between about 1 and about 8, and the temperature during treatment is between about 10° and about 85° C.

10. A process according to claim 3, wherein the total concentration of components (A), (B), and (C) in the treating solution containing them is between about 0.005 and about 0.05 w %, the pH of the treating solution is between about 1 and about 8, and the temperature during treatment is between about 10° and about 85° C.

11. A process according to claim 2, wherein the total concentration of components (A), (B), and (C) in the treating solution containing them is between about 0.005 and about 0.05 w %, the pH of the treating solution is between about 1 and about 8, and the temperature during treatment is between about 10° and about 85° C.

12. A process according to claim 1, wherein the total concentration of components (A), (B), and (C) in the treating solution containing them is between about 0.005 and about 0.05 w %, the pH of the treating solution is between about 1 and about 8, and the temperature during treatment is between about 10° and about 85° C.

13. A process according to claim 12, wherein the pH of the treating solution is between about 2 and about 5 and the temperature during treatment is between about 21° and about 54° C.

14. A process according to claim 11, wherein the pH of the treating solution is between about 2 and about 5 and the temperature during treatment is between about 21° and about 54° C.

15. A process according to claim 10, wherein the pH of the treating solution is between about 2 and about 5 and the temperature during treatment is between about 21° and about 54° C.

16. A process according to claim 9, wherein the pH of the treating solution is between about 2 and about 5 and the temperature during treatment is between about 21° and about 54° C.

17. A process according to claim 8, wherein the pH of the treating solution is between about 2 and about 5 and the temperature during treatment is between about 21° and about 54° C.

18. A process according to claim 7, wherein the pH of the treating solution is between about 2 and about 5 and the temperature during treatment is between about 21° and about 54° C.

19. A process according to claim 18, wherein, in the composition comprising components (A)-(C), the concentration of phosphorus is in the range from about 0.0005 to about 0.0015 gram atoms per liter and the total concentration of all the metal atoms recited in component (B) is in the range of about 0.0001 to about 0.003 gram atoms per liter.

20. A liquid composition of matter comprising water and the following components:

(A) a component of water soluble materials selected from the group conforming to general chemical formula I:

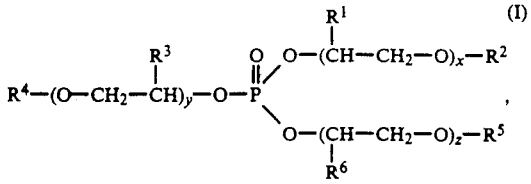

(I)

wherein each of $R^1$, $R^3$, and $R^6$ is independently selected from hydrogen and alkyl groups containing 1-about 4 carbon atoms each of x, y, and z is an integer and is independently selected within the range from 0-about 25; and each of $R^2$, $R^4$, and $R^5$ is independently selected from hydrogen, monovalent cations, monovalent fractions of polyvalent cations, alkyl groups containing 1-about 20 carbon atoms, and aryl and arylalkyl groups containing 1-about 20 carbon atoms, except that at least one of $R^2$, $R^4$, and $R^5$ is not hydrogen;

(B) a component selected from the group of water soluble salts containing ions that comprise atoms selected from the group consisting of Fe, Zr, Sn, Al, and Ce; and (C) a water soluble metal etching component; and, optionally, (D) a component selected from water soluble chelating agents for the metal containing ions of component (B); and (E) a water soluble component selected from molecules conforming to general formula II:

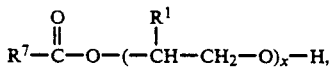

(II)

wherein $R^7$ is linear or branched, saturated or unsaturated aliphatic hydrocarbon moiety and $R^1$ and x have the same meaning as for formula I.

* * * * *

UNITED STATES PATENT AND TRADEMARK OFFICE

CERTIFICATE OF CORRECTION

PATENT NO. : 5,030,323

DATED : July 9, 1991

INVENTOR(S) : Sami B. Awad

It is certified that error appears in the above-identified patent and that said Letters Patent is hereby corrected as shown below:

At Column 8, in Claim 2, line 3, "$R^2$" should read --of $R^1$--.

Signed and Sealed this

Twenty-ninth Day of December, 1992

*Attest:*

DOUGLAS B. COMER

*Attesting Officer*

*Acting Commissioner of Patents and Trademarks*